US005942061A

United States Patent [19]

Figiel et al.

[11] Patent Number: 5,942,061

[45] Date of Patent: Aug. 24, 1999

[54] CAM OPERATED STRAP WELDING TOOL AND METHOD THEREFOR

[75] Inventors: Janusz Figiel, Mount Prospect; Peter Drabarek, Chicago, both of Ill.

[73] Assignee: Illinois Tool Works Inc., Glenview, Ill.

[21] Appl. No.: 09/054,663

[22] Filed: Apr. 3, 1998

[51] Int. Cl.[6] ..... B29C 65/06

[52] U.S. Cl. ..... 156/73.5; 156/229; 156/256; 156/494; 156/502; 156/530; 156/580; 100/33 PB

[58] Field of Search ..... 156/73.5, 157, 156/159, 229, 250, 256, 494, 502, 507, 510, 530, 580; 100/29, 32, 33 PB

[56] References Cited

U.S. PATENT DOCUMENTS

| | | | |
|---|---|---|---|
| 3,654,033 | 4/1972 | Angarola et al. | 156/494 |
| 4,952,271 | 8/1990 | Cheung et al. | 156/502 |
| 5,141,591 | 8/1992 | Boek et al. | 156/502 |
| 5,169,480 | 12/1992 | Toppel et al. | 156/358 |
| 5,238,521 | 8/1993 | Cheung et al. | 156/502 |
| 5,267,508 | 12/1993 | Yoshino | 100/26 |
| 5,306,383 | 4/1994 | Kobiella | 156/468 |
| 5,380,393 | 1/1995 | Drabarek et al. | 156/358 |

*Primary Examiner*—James Sells
*Attorney, Agent, or Firm*—Donald J. Breh

[57] ABSTRACT

A strap welding tool and method therefor including a first cam member for moving a sealing gripper toward a first support member to engage and retain tensioned strap disposed therebetween, a second cam member for enabling a vibrator motor to vibrate a welding pad, and a third cam member for moving they welding pad toward a second support member to engage and weld overlapping strap portions disposed therebetween. The tool includes a relatively small base plate to reduce loss of strap tension upon removal of the tool from between strap tensioned about small and irregular loads. A column strength of a strap portion engaged by the vibrating welding pad is reduced by deforming or bending the strap portion, and preferably forming a gap between upper and lower strap portions.

20 Claims, 2 Drawing Sheets

CAM OPERATED STRAP WELDING TOOL AND METHOD THEREFOR

CROSS REFERENCE TO RELATED APPLICATIONS

The present application is related to copending U.S. Application No. 09/054,715, entitled "Strap Welding Tool With Base Plate for Reducing Strap Column Strength and Method Therefor", filed concurrently and assigned commonly herewith.

BACKGROUND OF THE INVENTION

The invention relates generally to strapping tools, and more particularly to improved plastic strap welding tools useable in combination with strap tensioning tools and methods therefor.

In load packaging operations, it is known generally to weld overlapping portions of plastic strap tensioned about the load. U.S. Pat. No. 3,564,033, issued Apr. 4, 1972, entitled "Strap Tensioning and Sealing Tool" and assigned commonly herewith, for example, discloses a pneumatically operated strapping tool that forms a friction-fused joint, or weld, by vibrating contacting interfacial surfaces of overlapping plastic strap portions. The strapping tool includes a clamping member for anchoring a free strap end portion, and a rotatable feed wheel cooperating with an anvil foot to engage a feed strap portion, which is tensioned about the load. A clutch engagably couples the feed wheel to a pneumatic motor, which also vibrates a jaw that welds the overlapping strap portions. The motor stalls and tensioning stops at a specified strap tension, and a pneumatically actuated ram disengages the motor from the feed wheel and engages a feed wheel brake, which maintains feed wheel tension on the tensioned strap during welding. The actuated ram also moves the vibrating jaw into frictional engagement with the overlapping strap portions. As the vibrating jaw moves toward the overlapping strap portions, a shearing edge severs the upper strap, and the overlapping strap portions are subsequently welded together. Thereafter, pressure is maintained on the welded overlapping strap portions for a cool down period to complete the weld.

U.S. Pat. No. 5,380,393, issued Jan. 10, 1995, entitled "Hand Strapping Tool", also assigned commonly herewith and incorporated herein by reference, discloses a strapping tool having a pneumatic circuit for automatically controlling tool operation, including the timing and duration of strap welding and the cool down period. A pneumatically actuated ram extended after strap tensioning pivots a cam that moves a vibrating welding plate into contact with overlapping strap portions to form a weld. Vibration of the welding plate terminates after a time period controlled by the accumulation of air pressure in a chamber. Thereafter, air bled from a cylinder counter-pivots the cam to move the welding plate away from the welded strap portions after a cool down period.

Prior art pneumatic strapping tools require many system components that increase the size and weight of the tool, and increase costs related to tool manufacturing, operation and maintenance. The tool of U.S. Pat. No. 3,564,033, for example, requires a pneumatically actuated ram for disengaging the air motor from the feed wheel, engaging the feed wheel brake, and moving the vibrating jaw into engagement with the overlapping strap portions. U.S. Pat. No. 5,380,393 requires pneumatic rams for moving the welding plate into contact with the overlapping strap portions, and a combination of cylinders, chambers and valves for controlling the timing and duration of various tool operations. Although the pneumatic circuit of U.S. Pat. No. 5,380,393 automates many strapping operations performed manually in prior art tools, control and timing of the various tool operations is relatively imprecise, producing inconsistent strap tension and weld results.

Prior art strapping tools, including those discussed above, also have generally a relatively long base plate disposed between the strap and the load during strap tensioning and welding. Thereafter, the base plate is removed from between the tensioned strap and load. The relatively long base plate, however, has a tendency to create slack in the tensioned strap after its removal, particularly in applications where the load is relatively small or shaped irregularly. The loss in strap tension depends generally on the size of the base portion and on the size of the load, and in many cases results in inadequately tensioned strap.

The present invention is drawn toward advancements in the art of strapping tools generally, and more particularly to strapping tools for forming friction-fused joints, or welds, by vibrating contacting interfacial surfaces of overlapping strap portions, especially plastic strap portions.

It is an object of the invention to provide novel strap welding tools and methods therefor that overcome problems in the prior art, and novel strap welding tools that are economical to manufacture, operate and maintain.

It is also an object of the invention to provide novel strap welding tools, and more particularly plastic strap welding tools, and methods therefor that eliminate control and timing inconsistencies inherent in prior art pneumatically operated strapping tools by controlling various tool operations and especially the welding operation with cam members, which are preferably rotated by a common drive shaft.

It is a more particular object of the invention to provide novel strap welding tools and methods therefor having a first cam member for moving a sealing gripper toward a first support member to engage and retain tensioned strap disposed therebetween, a second cam member for enabling a vibrator motor to vibrate a welding pad, and a third cam member for moving the welding pad toward a second support member to engage and weld overlapping strap portions.

It is another object of the invention to provide novel strap welding tools and methods therefor having relatively small base plates to reduce loss of strap tension upon removal of the tool from strap tensioned about a load, particularly strap tensioned about relatively small and irregularly shaped loads.

It is another more particular object of the invention to provide novel strap welding tools and methods therefor comprising base plates having the first support member on a leading end portion thereof, the second support member on a second portion thereof, and a third support member cooperating with a tensioning gripper movable to engage and retain a free strap end portion during strap tensioning on a trailing end portion of the base plate, the second portion of the base plate intermediate the leading and trailing end portions thereof, and preferably the leading and trailing end portions slope downwardly away from the second portion.

It is a further object of the invention to provide novel strap welding tools and methods therefor that reduce column strength of a strap portion engagable by the vibrating welding pad by deforming the strap portion, and more particularly by bending the strap portion proximate the welding pad, preferably forming a gap between the overlapping strap portions.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
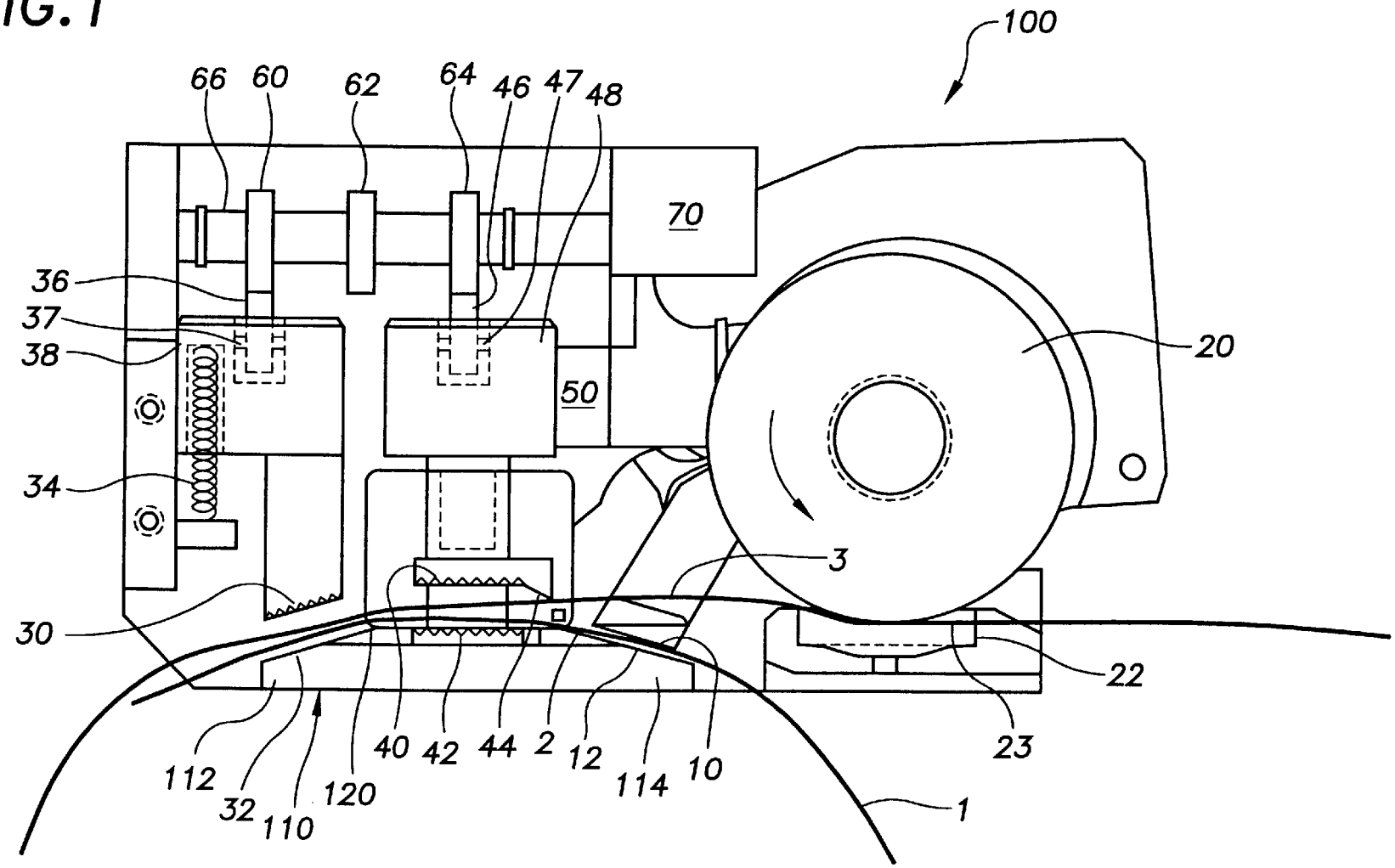
FIG. 1 is a partial side elevational view of an exemplary cam operated strapping tool for welding overlapping strap portions.

FIG. 1 illustrates a strapping tool 100 for welding a strap 1 tensioned about a load, not shown. The tool 100 comprises generally a tensioning gripper 10 movable toward a tension support 12 to engage and retain a free strap end portion 2 therebetween during strap tensioning. The gripping of the free strap end portion 2 may be controlled by manually depressing a gripping switch that actuates the tensioning gripper 10. A rotatable feed wheel 20 is movable toward a foot member 22 to engage and feed a feed strap portion 3 disposed therebetween. The tensioning of the feed strap portion 3 may be initiated by manually depressing a tensioning switch that actuates an air motor rotatably driving the feed wheel 20. The air motor stalls and the feed wheel 20 stops tensioning when a pre-determined level of strap tension is applied, as is known generally. The feed strap portion 3 partially overlaps the free strap portion 2 at a strap welding position where the overlapping strap portions are welding together as discussed further below.

In the exemplary embodiment, only the feed strap portion 3 is disposed between the feed wheel 20 and the foot member 22, and the foot member 22 has a relatively smooth surface 23 to permit sliding movement of the feed strap portion 3 therebetween during tensioning. In an alternative embodiment, the free strap end portion 2 and the feed strap portion 3 are both disposed between the feed wheel 20 and the foot member 22, and the foot member 22 has a toothed surface 23 to engage and retain the free strap end portion 2 while the feed strap portion 3 slides relative thereto during tensioning. Tensioning with only the feed strap portion 3 between the feed wheel 20 and the foot member 22 reduces strap slippage during tensioning, and permits reducing the effective base length of the tool, thereby reducing loss of strap tension upon removal of the tool from between the tensioned strap and the load, particularly small and irregular loads, as discussed further below.

Figure 4:
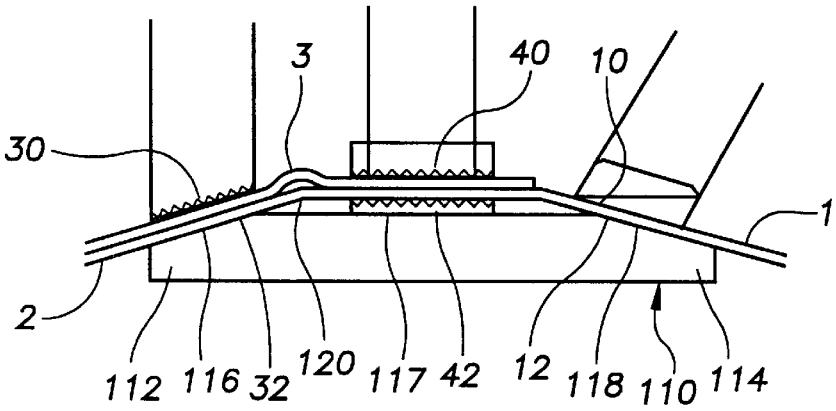
FIG. 4 is a partial side elevational view of overlapping strap portions on an exemplary base plate of the strapping tool.

FIGS. 1 and 4 illustrate the tool 100 including a sealing gripper 30 movable toward a first, or sealing, support member 32 to engage and retain overlapping strap portions after tensioning by the feed wheel 20 as discussed above. FIG. 1 illustrates the sealing gripper 30 biased away from the first support member 32 by a compressed spring member 34 or other known means. The tool 100 also includes a vibratable welding pad 40 movable toward a second, or welding, support member 42. The welding pad 40 is similarly biased away from the second support member 42. A vibrator motor 50 is actuatable to vibrate the welding pad 40, and preferably the vibrator motor 50 is a pneumatically operated air motor.

A first cam member 60 is operable to move the sealing gripper 30 against its bias and toward the first support member 32 to engage and retain tensioned strap disposed therebetween. A second cam member 62 is operable to enable the vibrator motor 50, which vibrates the welding pad 40, for example by actuating a pneumatic valve or switch. And a third cam member 64 is operable to move the welding pad 40 against its bias and toward the second support member 42 to engage and weld overlapping strap portions disposed therebetween.

Figure 2A:
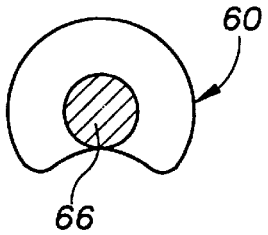
FIG. 2*a* is a partial sectional view of a first cam member of FIG. 1.
Figure 2B:
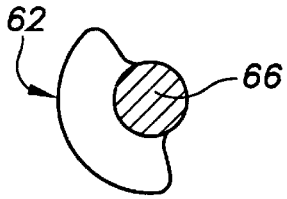
FIG. 2*b* is a partial sectional view of a second cam member of FIG. 1.
Figure 2C:
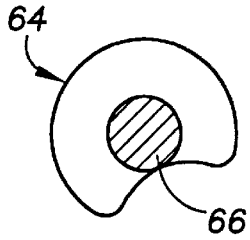
FIG. 2*c* is a partial sectional view of a third cam member of FIG. 1.

FIGS. 2*a*, 2*b* and 2*c* illustrate an exemplary cam assembly configuration wherein the first, second, and third cam members 60, 62 and 64 each have corresponding lobes and depressions for accurately controlling the actuation and timing of the sealing gripper 30, the vibration motor 50, and the welding pad 40, respectively. The radial position of the lobes and depressions of the cam members 60, 62 and 64 may vary depending upon the particular configuration of the tool. The position of the second cam member 62, for example, depends on the location of the vibrator motor 50 switch. The welding operation of the present invention is thus controlled without the relatively imprecisely controllable air cylinder actuated rams of the prior art.

The tool 100 preferably includes a first roller member 36 rotatable about an axle 37 coupled to an upper portion 38 of the sealing gripper 40. A second roller member 46 is similarly rotatable about an axle 47 coupled to an upper portion 48 of the welding pad 40. The first and second roller member 36 and 46 are engagable by the first and third cam members 60 and 64, respectively, to accurately actuate the sealing gripper 30 and the welding pad 40. The first and second roller members 36 and 46 also minimize mechanical wear and extend the operable life of the tool.

Figure 3:
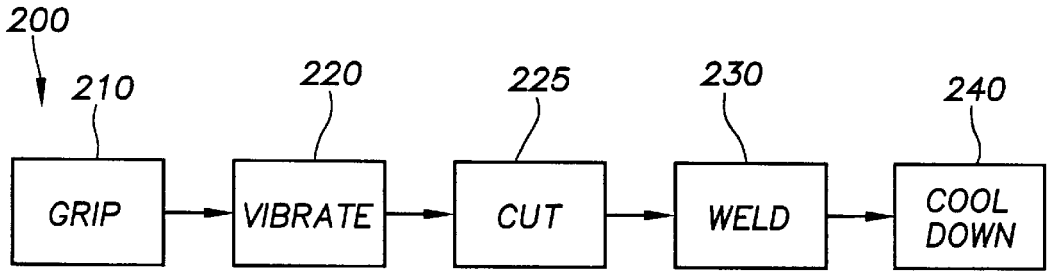
FIG. 3 is a strap welding tool operational flow diagram.

FIG. 3 is a flow diagram 200 illustrating generally the strap welding operation of the strapping tool 100. The sealing gripper 30 is moved toward the first support member 32 with the first cam member 60 to engage and retain tensioned strap disposed therebetween in a grip step 210. The vibrator motor 50 is actuated by the second cam member 62 to vibrate the welding pad 40 in a vibrate step 220, and the vibrating welding pad 40 is moved toward the second support member 42 by the third cam member 64 to engage and weld the overlapping strap portions in a weld step 230. The second cam member 62 disables the vibrator motor 50 while the third cam member 64 maintains the welding pad 40 positioned toward the second support member 42 to apply pressure on the welded strap portions for a cool down period after the vibrator motor 50 is disabled in a cool down step 240. Usage and wear on the vibrator motor 50 is minimized by operating the vibrator motor 50 only when required for welding, thereby extending the usable life thereof. The welding pad 40 is moved away from the second support member 42 upon expiration of the cool down period, and the sealing gripper 30 may be moved away from the gripper support member 32 any time after expiration of the cool down period.

FIGS. 1 and 3 illustrate the first, second, and third cam members 60, 62 and 64 preferably rotatably supported on a common drive shaft 66 to form a cam assembly rotatably drivable by a cam drive motor 70 coupled to the common drive shaft 66. Rotatably supporting the first, second and the third cam members 60, 62 and 64 with the common drive shaft 66 accurately and precisely controls actuation of the sealing gripper, actuation of the welding pad and the cool down time period, without the inconsistencies and variations inherent in the prior art pneumatically controlled welding operations. The cam drive motor 70 is preferably a pneumatically operated air motor, and is actuatable for example by manually depressing a weld switch after tensioning. The welding operations, or steps, performed by the cam members 60, 62 and 64, as illustrated generally in FIG. 3, proceed automatically and in controlled sequence upon rotation of the common drive shaft 66, whereafter the cam drive motor 70 may be disabled automatically until initiation of a subsequent welding operation by subsequent depressing of the weld switch.

FIG. 1 illustrates the tool 100 further comprising a strap shearing edge 44, which is preferably serrated, disposed on the welding pad 40 for cutting the upper strap portion, and more particularly cutting the feed strap portion ultimately engaged by the vibrating welding pad 40 as the vibrating welding pad 40 is moved toward the second support member 42, but before welding the overlapping strap portions. The flow diagram of FIG. 3 illustrates a strap severing or cut step 225 occurring after the vibrate step 220 and before the weld step 230. Cutting the upper strap portion has the advantage of permitting the cut upper strap portion to vibrate freely under the influence of the vibrating welding pad 40 as required to ensure a complete weld.

FIGS. 1 and 4 illustrate the strapping tool 100 further comprising a base plate 110 having generally reduced dimensions, particularly a reduced longitudinal dimension between a leading end portion 112 and a trailing end portion 114 thereof. The reduced dimensions of the base plate 110 facilitate strapping small and irregular shaped loads without loss of strap tension upon removal of the base plate 110 from between the load and the strap after tensioning and welding. The leading end portion 112 and the trailing end portion 114 of the base plate 110 are preferably disposed at angles sloping downwardly and away from the second support member 42, which is located therebetween, thereby further reducing the loss of strap tension upon removal of the base plate 110 by reducing a thickness of the base plate.

FIG. 4 illustrates the first support member 32 disposed on a first portion 116 corresponding generally to the leading end portion 112 of the base plate 110, and the second support member 42 disposed on a second portion 117 of the base plate 110. The third support member 12 is disposed on a third portion 118 corresponding generally to the trailing end portion 114 of the base plate 110.

In embodiments where the sealing gripper 30 and welding pad 40 are located very near each other, it is necessary to reduce a column strength of the overlapping strap portions prior to welding, and particularly the strap portion engaged by the vibrating welding pad 40. The relatively closely spaced sealing gripper 30 and welding pad 40 render the overlapping strap portions relatively rigid and inflexible, thereby interfering with, or obstructing, vibration thereof by the vibrating weld pad 40. This is especially true where the distance between the sealing gripper 30 and the welding pad 40 is less than approximately 2 inches, as in the exemplary embodiment where a base plate 110 of the tool 100 having relatively reduced dimension forms the first and second support members 32 and 42 for the sealing gripper 30 and the welding pad 40, respectively. Reducing the column strength of the strap portion engaged by the vibrating welding pad 40 ensures liberal vibratory movement of the strap portion, as is required for proper welding.

FIG. 4. illustrates the upper strap portion 3 of the overlapping strap portions at least partially deformed to reduce the column strength thereof, deformation being preferably in a direction away from the first and second support surfaces 32 and 42 between the sealing gripper 30 and the welding pad 40. FIGS. 1 and 4 illustrate the first support member 32 located in a first plane, and the second support member 42 located in a second plane at an angle relative to the first plane, wherein the first and second support members 32 and 42 intersect to form a vertex 120. The vertex 120 may be formed alternatively by another member, for example a rod or bar or other member disposed across the base plate 110 above a common plane of the first and second support members. The column strength is reduced by bending the overlapping strap portions over the vertex 120. A gap is preferably formed between the upper strap portion 3 and a lower strap portion 2 of the overlapping strap portions to further reduce the rigidity or column strength of the upper strap portion 3, and permit a greater degree of vibrational freedom under the vibratory action of the welding pad 40 to ensure an even stronger weld.

While the foregoing written description of the invention enables one of ordinary skill in the art to make and use what is at present considered to be the best mode of the invention, it will be appreciated and understood by those of ordinary skill the existence of variations, combinations, modifications and equivalents within the spirit and scope of the specific exemplary embodiments disclosed herein. The present invention is therefore to be limited not by the specific exemplary embodiments disclosed herein but by all embodiments within the scope of the appended claims.

What is claimed is:

1. A method for welding overlapping strap portions with a strapping tool, the method comprising:

moving a sealing gripper toward a first support member with a first cam member to engage and retain tensioned strap disposed between the sealing gripper and the first support member;

enabling a vibrator motor with a second cam member to vibrate a welding pad; and moving the vibrating welding pad toward a second support member with a third cam member to engage and weld overlapping strap portions disposed between the welding pad and the second support member.

2. The method of claim 1 further comprising disabling the vibrator motor with the second cam member, and maintaining the welding pad positioned toward the second support member with the third cam member for a cool down period after disabling the vibrator motor, and moving the welding pad away from the second support member after the cool down period.

3. The method of claim 1 further comprising rotatably driving the first cam member, the second cam member, and the third cam member with a common drive shaft to accurately control actuation of the sealing gripper, actuation of the welding pad and the cool down time period.

4. The method of claim 1 further comprising cutting an upper strap portion before welding the overlapping strap portions.

5. The method of claim 4 further comprising cutting the upper strap portion with a shearing edge disposed on the welding pad as the vibrating welding pad is moved toward the second support member.

6. The method of claim 1 further comprising tensioning strap disposed about a load with a strap tensioning feed wheel, and retaining a free strap end portion with a tensioning gripper during strap tensioning.

7. The method of claim 1 further comprising reducing column strength of an upper strap portion of the overlapping strap portions between the sealing gripper and the welding pad before welding.

8. The method of claim 7 further comprising reducing column strength by at least partially deforming the upper strap portion.

9. The method of claim 7 further comprising reducing column strength by bending the upper strap portion and forming a gap between the upper strap portion and a lower strap portion of the overlapping strap portions.

10. The method of claim 7 further comprising engaging the tensioned strap disposed between the sealing gripper and the first support member located in a first plane, and engaging the overlapping strap portions disposed between the welding pad and the second support member located in a second plane different than the first plane.

11. A strapping tool for welding overlapping strap portions, the strapping tool comprising:

a sealing gripper movable toward a first support member;

a vibratable welding pad movable toward a second support member;

a vibrator motor actuatable to vibrate the welding pad;

a first cam member for moving the sealing gripper toward the first support member to engage and retain tensioned strap disposed between the sealing gripper and the first support member;

a second cam member for enabling the vibrator motor to vibrate the welding pad; and a third cam member for moving the welding pad toward the second support member to engage and weld overlapping strap portions disposed between the welding pad and the second support member.

12. The strapping tool of claim 11 further comprising a cam assembly having a common drive shaft for rotatably supporting the first cam member, the second cam member and the third cam member.

13. The strapping tool of claim 12 further comprising a cam drive motor rotatably coupled to the common drive shaft of the cam assembly.

14. The strapping tool of claim 11 further comprising a strap shearing edge disposed on the welding pad for cutting an upper strap portion as the welding pad moves toward the second support member.

15. The strapping tool of claim 11 further comprising a first roller member coupled to the sealing gripper and engagable by the first cam member, a second roller coupled to the welding pad and engagable by the third cam member, and a switch engageable by the second cam member for actuating the vibrator motor.

16. The strapping tool of claim 11 further comprising a vertex formed between the sealing gripper and the welding pad, the overlapping strap portions bendable over the vertex to reduce column strength of at least one of the overlapping strap portions.

17. The strapping tool of claim 16 further comprising a base plate, the first support member disposed on a leading end portion of the base plate, the second support member disposed on a second portion of the base plate, the leading end portion of the base plate at an angle relative to the second portion of the base plate to form the vertex.

18. The strapping tool of claim 11 further comprising a strap tensioning feed wheel movable toward a foot member to engage and tension a feed strap portion, and a tensioning gripper movable toward a third support member to engage and retain a free strap end portion during strap tensioning.

19. The strapping tool of claim 18 further comprising the first support member on a leading end portion of the base plate, the second support member on a second portion of the base plate at an angle relative to the leading end portion of the base plate.

20. The strapping tool of claim 19 further comprising the third support member on a trailing end portion of the base plate, the second portion of the base plate intermediate the leading end portion of the base plate and the trailing end portion of the base plate, the leading end portion and the trailing end portion sloping downwardly away from the second portion of the base plate.

* * * * *